United States Patent [19]

Arai

[11] Patent Number: 4,748,444

[45] Date of Patent: May 31, 1988

[54] LCD PANEL CMOS DISPLAY CIRCUIT

[75] Inventor: Yasuo Arai, Tokyo, Japan

[73] Assignee: OKI Electric Industry Co., Ltd., Tokyo, Japan

[21] Appl. No.: 800,342

[22] Filed: Nov. 21, 1985

[30] Foreign Application Priority Data

Nov. 22, 1984 [JP] Japan ..... 59-247434

[51] Int. Cl.[4] ..... G09G 3/36

[52] U.S. Cl. ..... 340/784; 340/765; 350/332; 350/333

[58] Field of Search ..... 340/765, 784; 350/332, 350/333

[56] References Cited

U.S. PATENT DOCUMENTS

| | | | |
|---|---|---|---|
| 3,653,745 | 4/1972 | Mao | 340/765 |
| 4,127,848 | 11/1978 | Shanks | 340/784 |
| 4,386,352 | 5/1983 | Nomomara et al. | 340/784 |
| 4,604,617 | 8/1986 | Morozumi | 340/784 |
| 4,626,841 | 12/1986 | Togashi | 340/784 |
| 4,630,122 | 12/1986 | Morokawa | 340/784 |
| 4,633,242 | 12/1986 | Sekiya | 340/784 |

*Primary Examiner*—Gerald L. Brigance
*Assistant Examiner*—Jeffery A. Brier
*Attorney, Agent, or Firm*—Wenderoth, Lind & Ponack

[57] ABSTRACT

An LCD panel display circuit for AC-driving a LCD panel with using a plurality of bias voltages has a display data interrupting circuit and an operation mode switching circuit, and the liquid crystal display panel includes a plurality of display cells having a plurality of X and Y electrodes arranged in a matrix form. The display data interrupting circuit interrupts the display data transmitted to the X and Y electrodes of the LCD panel in the operation mode thereof in which all of the display cells are in an inactive state. The operation mode switching circuit generates a control signal for allowing the same voltage to be applied to all of the X and Y electrodes of the LCD panel.

4 Claims, 11 Drawing Sheets

LCD PANEL CMOS DISPLAY CIRCUIT

BACKGROUND OF THE INVENTION

1. Field of the Invention

The present invention relates to a display circuit best suited to the line-scan-control of a liquid crystal (LCD) panel.

2. Description of the Prior Art

Liquid crystal display panels have been conveniently used in electronic timepieces and portable word processors, etc. because they can be operated with extremely low power consumption and provide a flat screen. The LCD panels are generally operated with AC driving signals, because DC voltages shorten the effective operational life of the LCD panel.

In an AC driving operation, a plurality of different DC bias voltages are selected with reference to scanning data and display data to produce AC driving signals which are supplied to the X and Y electrodes of the LCD panel. For example, when a voltage difference between the X and Y electrodes of an LCD panel of the nematic type exceeds a threshold voltage, it will disorient the molecular orientation of the liquid crystal layer, thus resulting in a display or lighting condition. On the other hand, when the voltage difference is less than the threshold value, it orients the liquid crystal molecules in the vertical direction, thus resulting in the non-display condition.

In the conventional display circuit, in order to place all of the display cells of the LCD panel in their non-active condition, a voltage having a value which does not exceed the threshold value is supplied between the X and Y electrodes of each of the display cells. However, this is disadvantageous in that since an AC signal less than the threshold value is supplied to each of the X and Y electrodes in the LCD panel, a discharging or charging current flows through the equivalent capacitance of the display cells, thus increasing the operational power consumption.

SUMMARY OF THE INVENTION

It is an object of the present invention to provide an LCD display circuit capable of reducing the power consumption for all of the display cells of an LCD panel in the inactive mode thereof.

Another object of the present invention is to provide an LCD display circuit capable of reducing a charging or discharging current flowing through display cells of an LCD panel in the inactive mode.

According to the present invention, an LCD panel display circuit for linear-scanning and controlling an LCD panel, which is composed of a plurality of X and Y electrodes arranged in a matrix form and a plurality of liquid crystal display cells, has a means for interrupting the scanning and display data supplied to the X and Y electrodes of the LCD panel in an operation mode thereof in which all of the display cells of the LCD panel are placed in an inactive state, and also has a bias means for supplying the same voltage to the X and Y electrodes of the LCD panel in this operation mode.

According to the present invention, an LCD panel display circuit for linear-scanning and controlling a liquid crystal display panel, which has a plurality of the X and Y electrodes arranged in a matrix and a plurality of display cells, has a bias means for providing a plurality of prescribed bias voltages V in an operation mode in which the LCD panel is made active, and also has a switch means for interrupting an output data from the bias means, and for supplying the same fixed voltage to the X and Y electrodes of the LCD panel.

These objects may be effected by providing an LCD panel CMOS display circuit for line-scanning and controlling an LCD panel having a plurality of X and Y electrodes arranged in a matrix form and having a plurality of liquid crystal display cells between said X and Y electrodes, comprising:

(a) a timing control circuit for generating a serial scanning data signal, a serial display data signal, a first shift clock signal, a second shift clock signal, a first control signal, and a second control signal;

(b) a multi-power source for producing a first group of bias voltages and a second group of bias voltages;

(c) a scanning data converter coupled to said timing control circuit for sequentially converting said scanning data from said timing control circuit in response to said first shift clock signal so as to convert said scanning data into scanning data in a parallel form which are output on a plurality of output lines;

(d) a first gate having a plurality of output lines and coupled to said output lines of said scanning data converter for selectively transmitting said scanning data from said converter in response to said first control signal;

(e) an X-bias selection circuit coupled to said first gate and including a plurality of first decoders and a plurality of drivers, each of said plurality of decoders coupled to one of said output lines of said first gate for converting a signal supplied thereto into a specific coded signal in response to a third control signal, each of said plurality of drivers coupled to a different one of said plurality of decoders for delivering a specific one of said first group of bias voltages to one of said X electrodes of said LCD matrix panel in response to its specific coded signal;

(f) a display data holding circuit for converting said serial display data signal into parallel data in response to said second shift clock signal and for selectively outputting said parallel data on a plurality of output lines in response to said first shift clock signal;

(g) a second gate having a plurality of output lines and coupled to said output lines of said display data holding circuit for selectively transmitting said parallel data in response to said first control signal;

(h) a Y-bias selection circuit coupled to said second gate including a plurality of second decoders and a plurality of drivers, each of said plurality of decoders coupled to one of said output lines of said second gate for converting a signal supplied thereto into a specific coded signal in response to a fourth control signal, each of said plurality of drivers coupled to different one of said plurality of decoders for delivering a specific one of said second group of bias voltages to one of said Y electrodes of said LCD matrix panel in response to its specific coded signal; and (i) a mode switching circuit coupled to said first and second pluralities of decoders for transmitting said second control signal to said first and second pluralities of decoders when said first control signal is in a first logic level, whereby said LCD panel is placed in a display mode, and for ceasing the transmission of said second control signal when said first control signal is in a second logic level, whereby the same bias voltage is provided to said X and Y electrodes of said LCD panel so as to place said LCD panel in a non-display mode.

These objects also may be effected by providing an LCD panel CMOS display circuit for line-scanning and controlling an LCD panel having a plurality of X and Y electrodes arranged in a matrix form and having a plurality of liquid crystal display cells between said X and Y electrodes, comprising:

(a) a timing control circuit for generating a serial scanning data signal, a serial display data signal, a first shift clock signal, a second shift clock signal, a first control signal, and a second control signal;

(b) a multi-power source for producing a first group of bias voltages and a second group of bias voltages;

(c) a scanning data converter coupled to said timing control circuit for sequentially converting said scanning data from said timing control circuit in response to said first shift clock signal so as to convert said scanning data into scanning data in a parallel form which are output on a plurality of output lines;

(d) an X-bias selection circuit coupled to said scanning converter and including a first plurality of decoders and a plurality of drivers, each of said plurality of decoders coupled to one of said output lines of said scanning data converter for converting a signal supplied thereto into a specific coded signal in response to said first control signal, each of said plurality of drivers coupled to a different one of said plurality of decoders for delivering a specific one of said first group of bias voltage in response to said specific coded signal;

(e) a first gate coupled to said X-bias selection circuit for selectively transmitting either specific bias voltages from said plurality of decoders or a different bias voltage to said X electrodes of said LCD panel in response to said second control signal;

(f) a display data holding circuit for converting said serial display data signal into a parallel display data in response to said second shift clock signal and for selectively outputting said parallel data or a plurality of output lines in response to said first shift clock signal;

(g) a Y-bias selection circuit coupled to said display data holding circuit and including a second plurality of decoders and a plurality of drivers, each of said plurality of decoders coupled to one of said output lines of said display data holding circuit for converting a signal supplied thereto into a specific coded signal in response to said first control signal, each of said plurality of drivers coupled to a different one of said plurality of decoders for delivering a specific one of said second group of bias voltages in response to its specific coded signal; and (h) a second gate coupled to said Y-bias selection circuit for selectively transmitting either specific bias voltages from said plurality of decoders or said different bias voltage to said Y electrodes of said LCD panel in response to said second control signal, whereby said different bias voltage is supplied to said X and Y electrodes in a non-display mode of said LCD panel.

The above and other objects, features and advantages of the invention will be more apparent from the following detailed description taken in conjunction with the accompanying drawings.

DESCRIPTION OF THE PREFERRED EMBODIMENT

An LCD matrix panel display circuit according to the present invention will be described with reference to FIGS. 1 to 8.

Figure 1A:
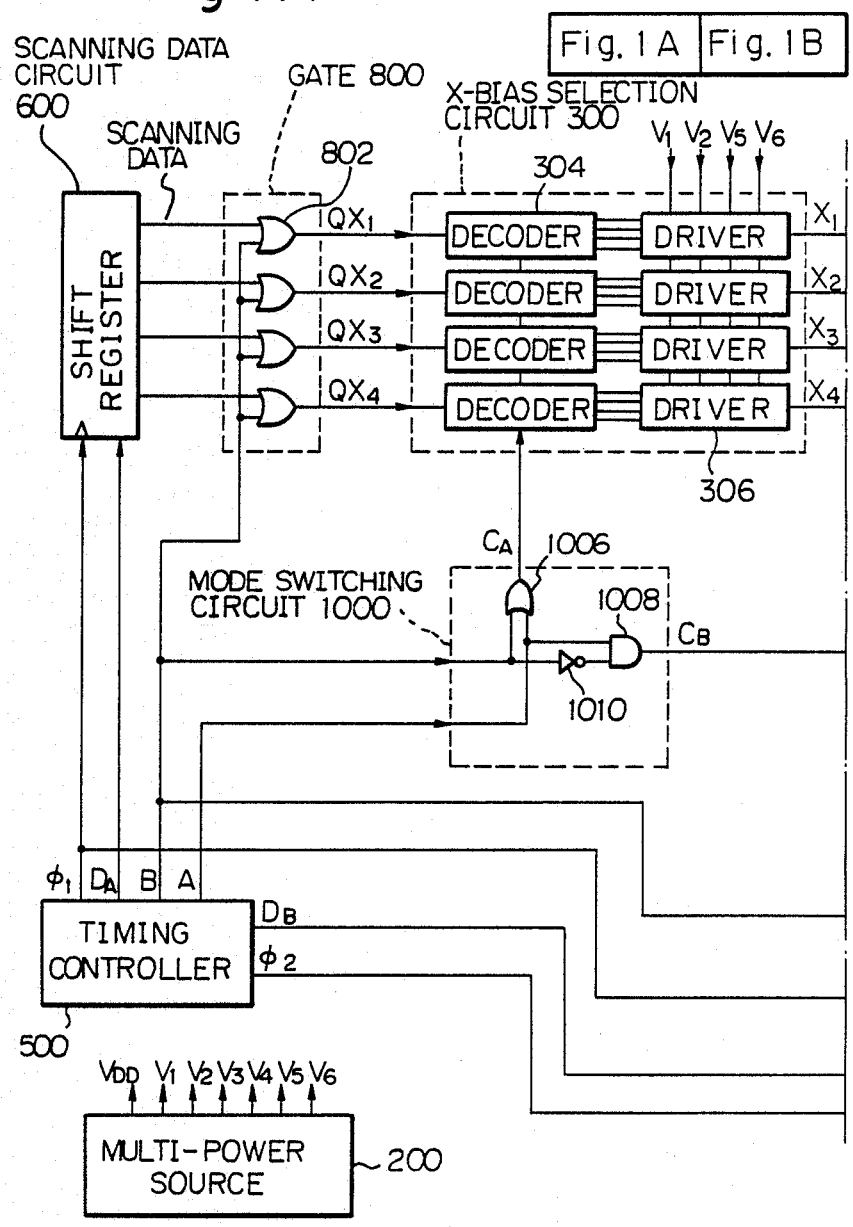
FIG. 1 consisting of FIGS. 1A and 1B, is a circuit diagram illustrating an embodiment of a LCD matrix panel display circuit according to the present invention.
Figure 1B:
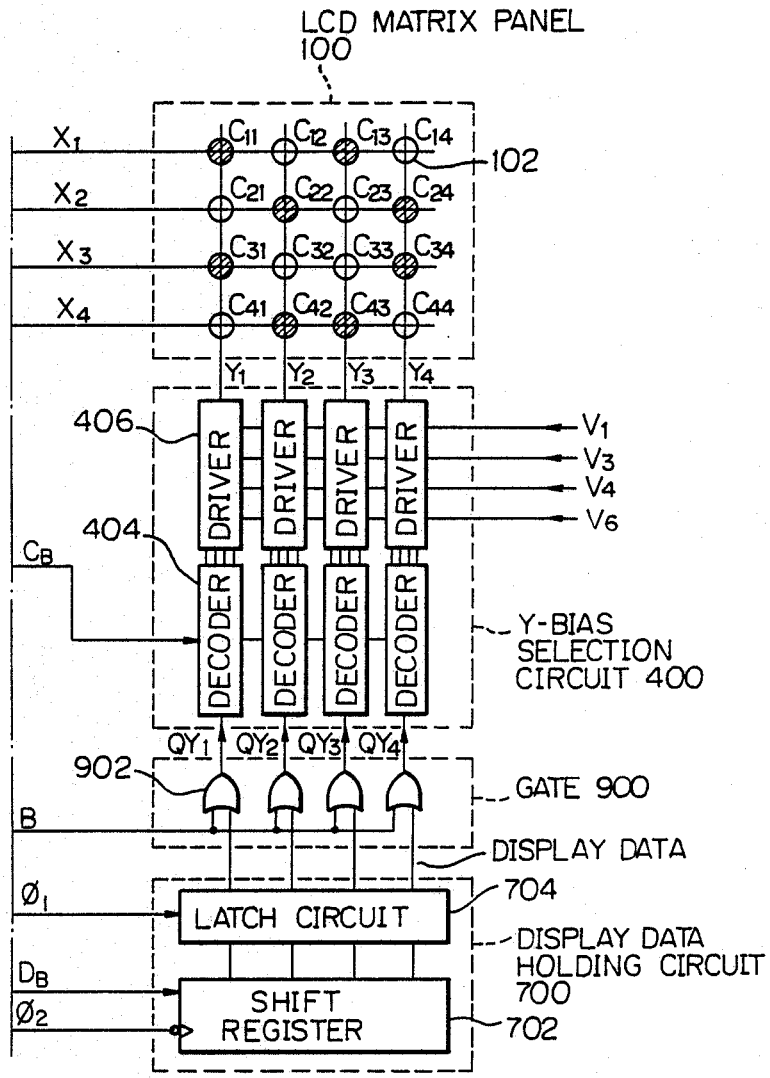

As shown in FIG. 1, consisting of FIGS. 1A and 1B, an LCD display circuit for operating a 16 bit LCD matrix panel 100 has a multi-power source 200 for generating a plurality of bias voltages ($V_1$, $V_2$, $V_3$, $V_4$, $V_5$, $V_6$), an X-bias selection circuit 300 for optionally supplying the bias voltages ($V_1$, $V_2$, $V_5$, and $V_6$) of the multi-power source 200 to electrodes $X_1$ to $X_4$ of the LCD panel 100 in response to a control signal $C_A$ and for generating an AC signal for driving the X electrodes, and a Y-bias selection circuit 400 for optionally supplying the bias voltages $V_1$, $V_3$, $V_4$ and $V_6$ of the multi-power source 200 to electrodes $Y_1$ to $Y_4$ of the LCD panel 100 in response to a control signal $C_B$, and for generating an AC signal for driving Y electrodes.

Furthermore, the LCD display circuit includes a timing controller 500 for generating a serial scanning data signal $D_A$, a serial display data signal $D_B$, shift clock signals $\phi_1$ and $\phi_2$ and timing signals B and A, a scanning data circuit 600 for holding the serial scanning data signal $D_A$ and for converting the serial scanning data signal $D_A$ to parallel scanning data which serves to select one of output serial data lines, and a display data holding circuit 700 for holding the serial display data signal $D_B$ and for delivering parallel display data.

Still more, the LCD display circuit includes a gate 800 comprising, for example, OR gates 802, for optionally delivering scanning data from the scanning data circuit 600 to the X-bias selection circuit 300, a gate 900 comprising, for example, OR gates 902 for optionally delivering the display data from the display data holding circuit 700 to the Y-bias selection circuit 400, and a mode switching circuit 1000 for controlling the selection circuits 300 and 400 based on the timing control signals A and B.

The X-bias selection circuit 300 has, for example, a decoder 304 for delivering output data which serves to select a desired bias voltage, and a driver circuit 306 for selecting a prescribed bias voltage in accordance with the output data of the decoder 304 and for supplying the selected voltage to the X electrodes of the LCD panel.

Figure 2:
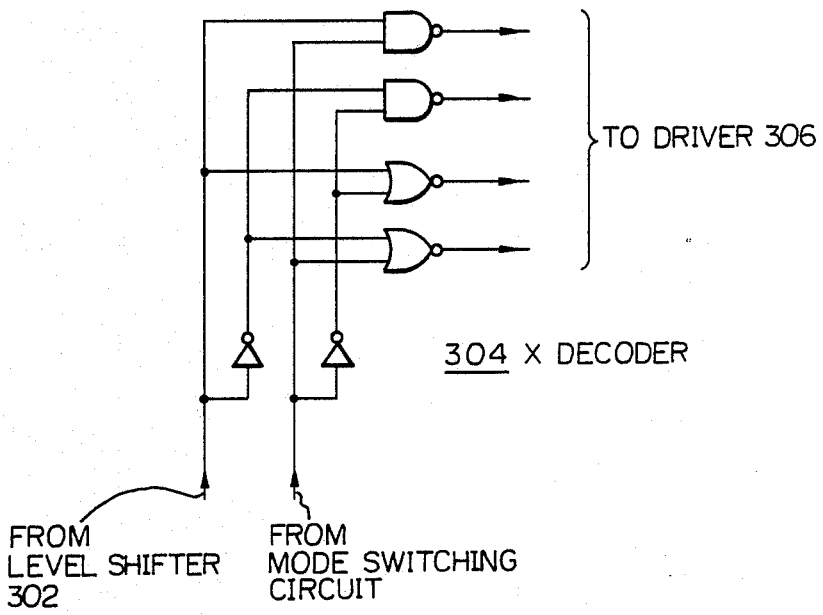
FIG. 2 is a circuit diagram of an X decoder for selecting X electrodes of the LCD panel of FIG. 1.
Figure 3:
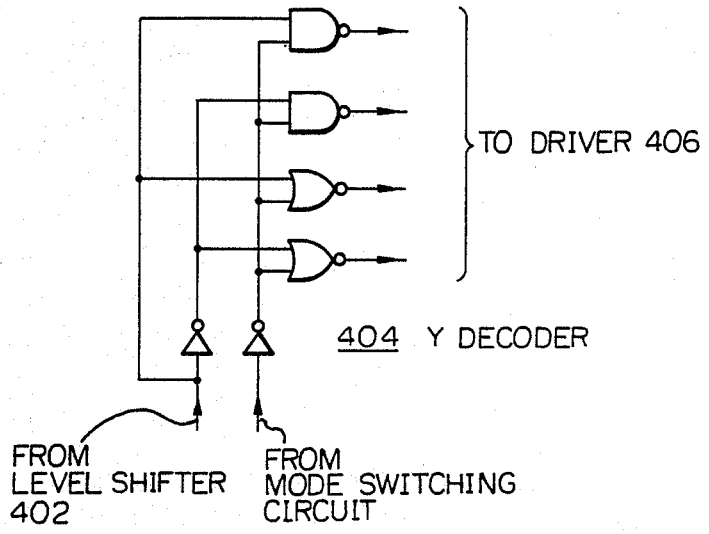
FIG. 3 is a circuit diagram of Y decoder for selecting Y electrodes of the LCD panel of FIG. 1.

The decoders 304 and 404 respectively may include, for example, as shown in FIGS. 2 and 3, NANDs, NORs and MOS inverters.

The scanning data circuit 600 comprises, for example, a shift register comprising MOS transistors.

The display data holding circuit 700 comprises, for example, a MOS shift register 702 and a MOS latch circuit 704.

Figure 4:
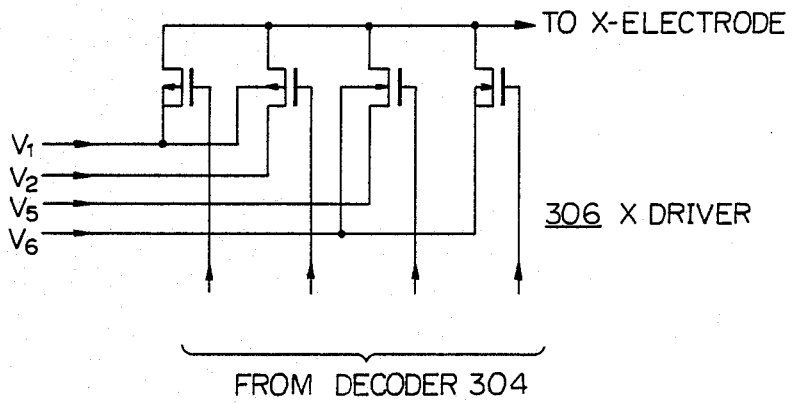
FIG. 4 is a circuit diagram of a driver for driving the X electrodes of the LCD panel of FIG. 1.

The drive circuit 306 comprises, for example, as shown in FIG. 4, P and N type MOS transistors.

Figure 5:
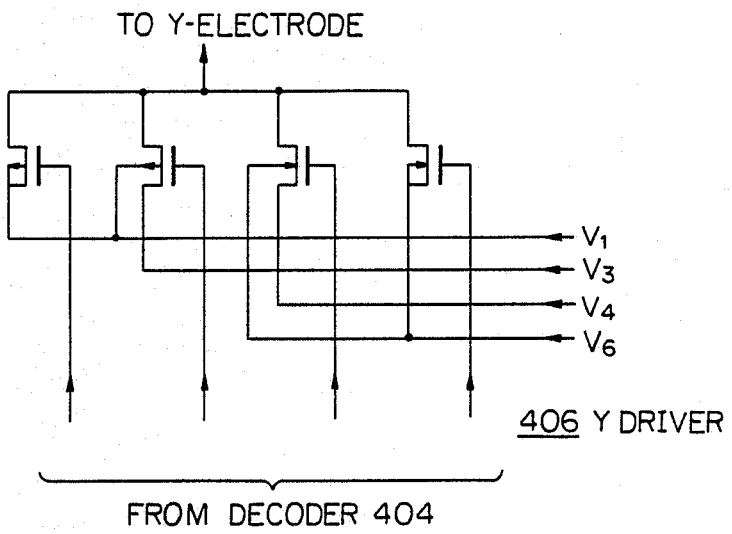
FIG. 5 is a circuit diagram of a driver for driving the Y electrodes of the LCD panel of FIG. 1.

The drive circuit 406 comprises, for example, as shown in FIG. 5, P and N type MOS transistors.

Figure 6:
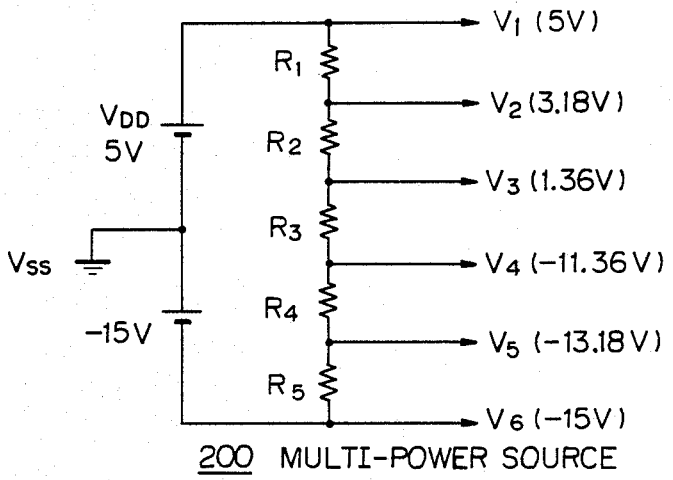
FIG. 6 is a circuit diagram of a multi-source voltage supply circuit for the LCD panel.

The multi-power source 200 comprises, for example, as shown in FIG. 6, 5 V and −15 V power sources, and a resistance—type potential divider, which supplies voltages $V_1$(5 V), $V_2$ (3.18 V), $V_5$(−13.18 V), and $V_6$(−15 V) to the X-bias selection circuit 300, while applying voltages $V_1$(5 V), $V_3$(1.36 V), $V_4$(−11.36 V), and $V_6$(−15 V) to the Y-bias selection circuit 400.

The mode switching circuit 1000 comprises, for example, an MOS inverter 1010, an OR gate 1006, and an AND gate 1008.

Figure 7A:
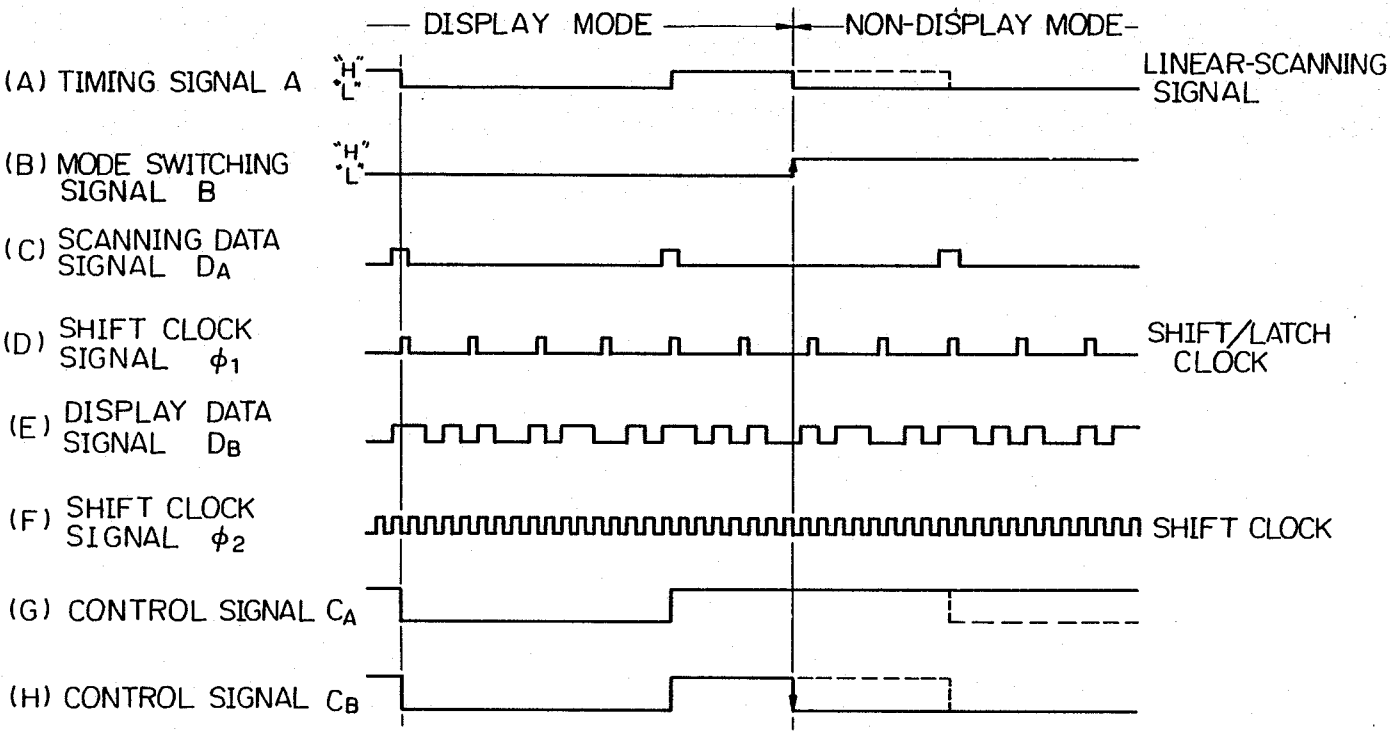
FIGS. 7A–7C are timing charts illustrating the operation of the LCD display circuit of FIG. 1.
Figure 7B:
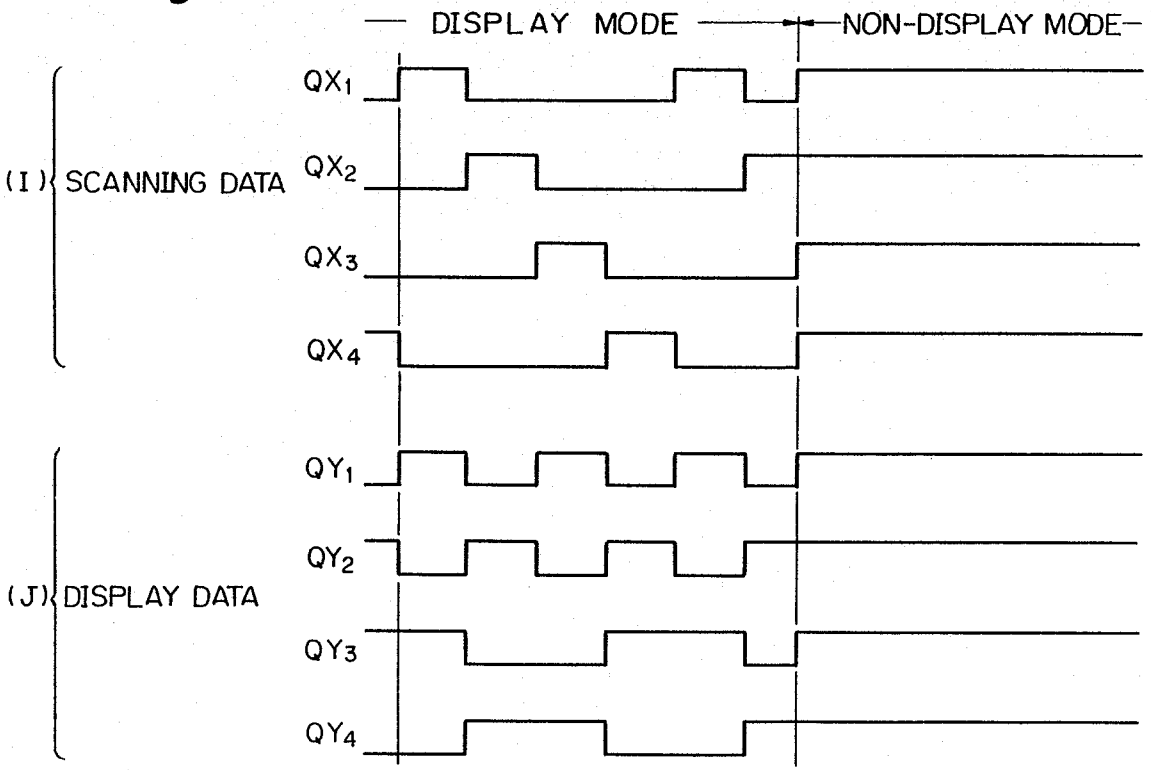
Figure 7C:
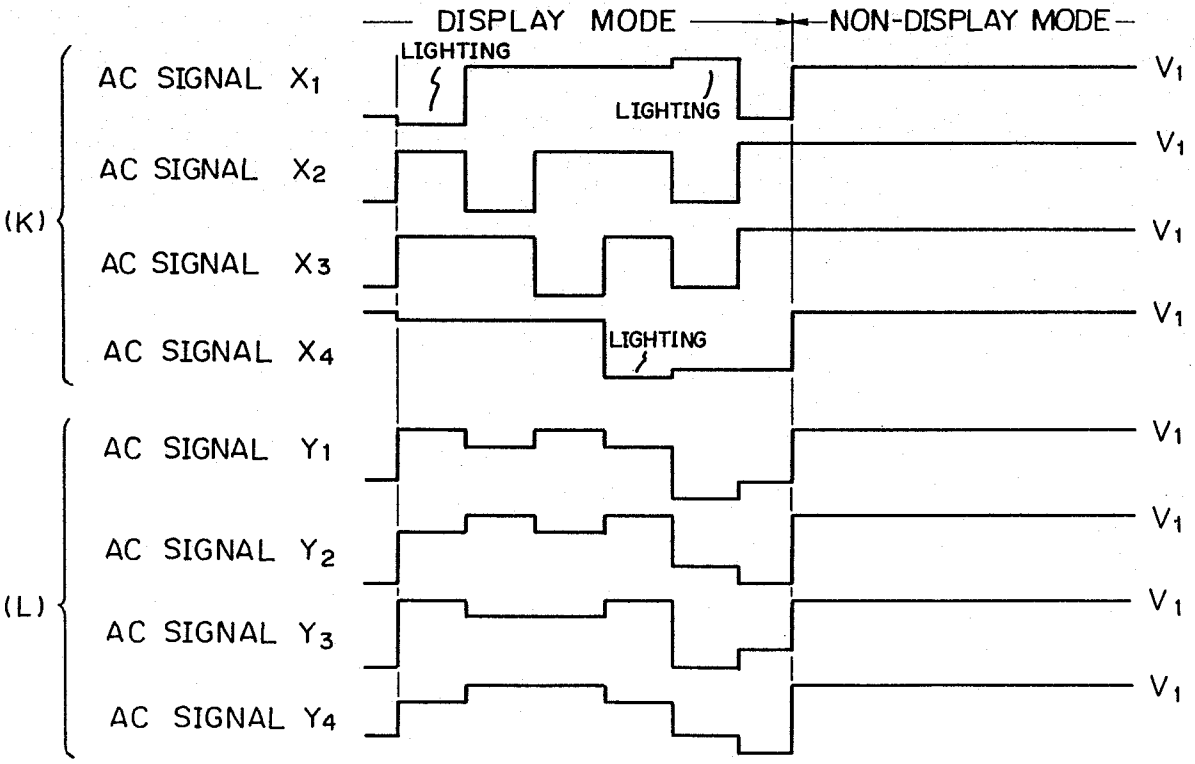

The operation of the LCD panel display circuit of the present invention will be described with reference to a timing charts of FIGS. 7A–7C.

The timing controller 500 supplies shift clock signals $\phi_1$ and $\phi_2$ to the shift registers 600 and 702 at all times.

The shift register 600 accordingly delivers a serial scanning data signal $D_A$ and parallel scanning data. Simultaneously, the holding circuit 700 holds a serial display data signal $D_B$ and delivers parallel display data.

In a display mode, the timing controller 500 delivers a timing signal A of about 70 Hz and a "L" level mode switching signal B.

Accordingly, the gate 800 supplies scanning data QX1, QX2, QX3, and QX4 X-bias selection circuit 300, while the gate 900 delivers display data $QY_1$, $QY_2$, $QY_3$, and $QY_4$ to the Y-bias selection circuit 400.

The mode switching circuit 1000 respectively provides control signals $C_A$ and $C_B$, which are synchronized with the timing signal A, to the decoders 304 and 404.

The decoder 304 provides a code signal in conformity with both each bit signal of the scanning data and the control signal $C_A$, and selects a corresponding bias voltage from the voltages $V_1$, $V_2$, $V_5$, and $V_6$ to supply to the X electrodes of the LCD panel 100.

In addition, the decoder 404 provides a code signal in conformity with each bit signal of the display data, and selects a corresponding bias voltage from the bias voltages $V_1$, $V_3$, $V_4$, and $V_6$ to supply to the Y electrodes of the LCD panel.

In the present invention, a high voltage which is over a voltage threshold is supplied across the X and Y electrodes of the display cells $C_{11}$, $C_{13}$, $C_{22}$, $C_{24}$, $C_{31}$, $C_{34}$, $C_{42}$, $C_{43}$ of the LCD panel 100, so that the LCD panel 100 is placed in the active state, i.e., the display state.

Then, in the non-display mode of all of the cells, the timing controller 500 provides the "H" level mode switching signal B to the switching circuit 1000, whereby the control signals $C_A$ and $C_B$ respectively become "H" and "L" levels.

The gates 800 and 900 interrupt output data from the shift register 600 and the latch circuit 704 in accordance with the mode switching signal B, and allows all of the outputs of the shift register 600 and the latch circuit 704 to become an "H" level.

All of the output data from the respective X decoders 304 become the same value due to the "H" level control signal $C_A$, and the X decoders select, for example, the bias voltage $V_1$ to supply to the respective X electrodes.

On the contrary, the output data from the Y decoders 404 become the same value, and the Y decoders select, for example, the bias voltage $V_1$ to supply to the respective Y electrodes.

In this mode, all of the display cells are placed in the inactive state since the same signal is supplied across the X and Y electrodes. Accordingly, power consumption due to a charging/discharging current can be prevented.

It is also possible to supply the control signal $C_A$ from the control circuit 1000 to the decoder 404 of the selection circuit 400 while supplying the control signal $C_{13}$ to the decoder 304 of the X-bias selection circuit 300. In this instance, in the inactive mode, the bias voltage $V_6$, for example, is supplied to the X and Y electrodes.

In the embodiment of the present invention, power consumption of the display circuit can be easily reduced by forming the display circuit by a MOS transistor process, more particularly by a CMOS IC process.

Figure 8A:
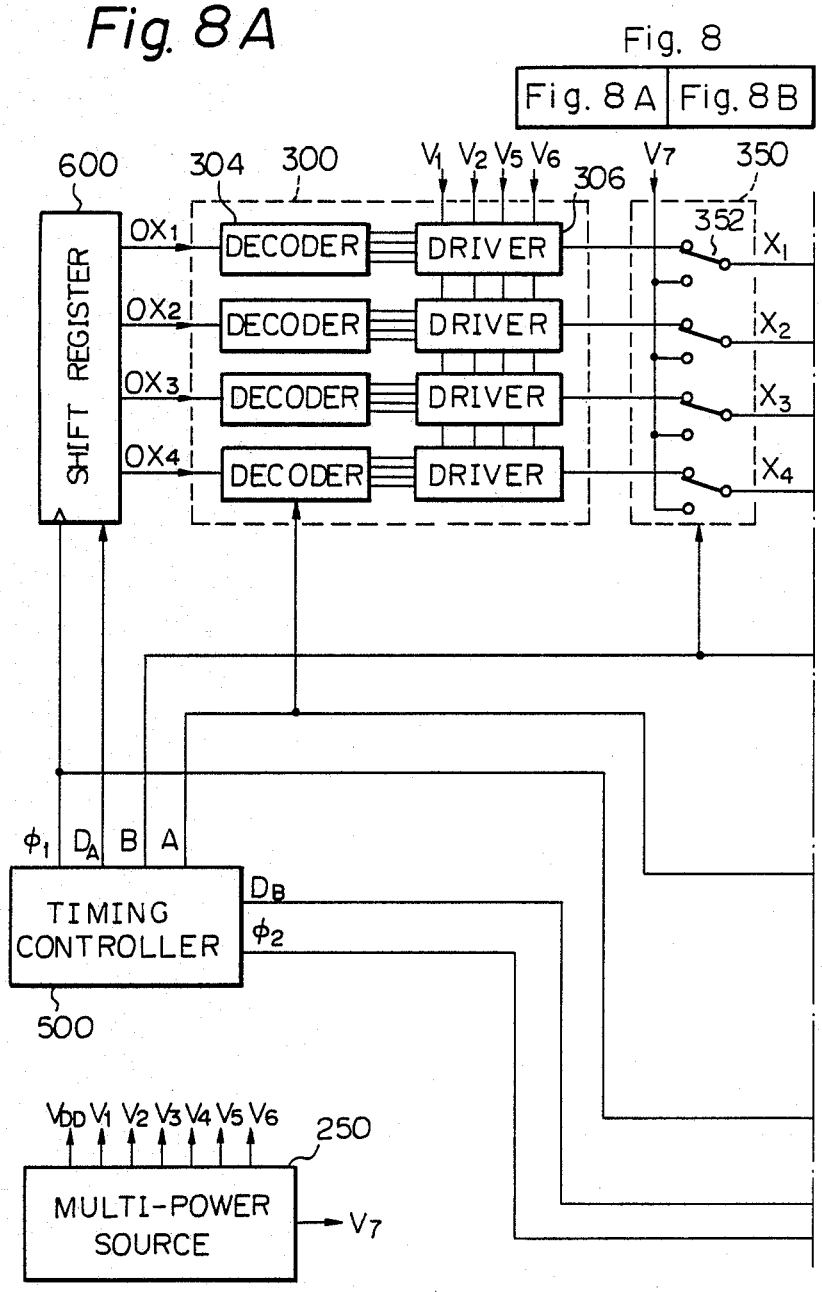
FIG. 8, consisting of FIGS. 8A and 8B, is a circuit diagram illustrating other embodiment of an LCD matrix panel display circuit according to the present invention.
Figure 8B:
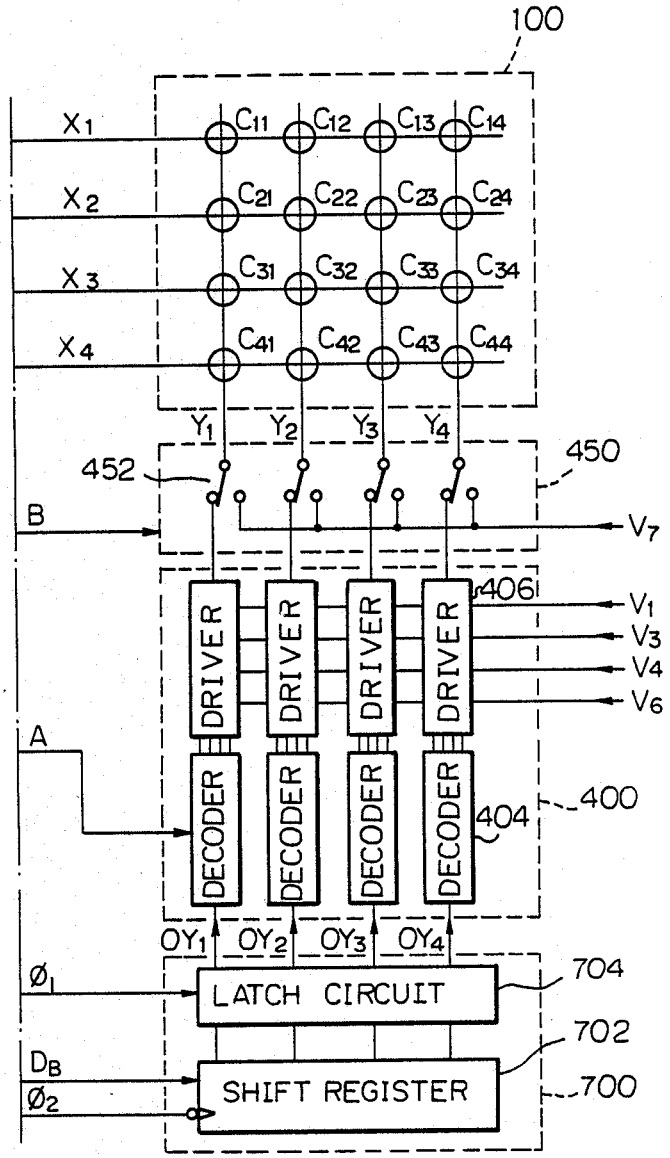

FIG. 8, consisting of FIGS. 8A and 8B, illustrates another embodiment of an LCD matrix display of the present invention, in which the operation of the LCD panel 100, bias selection circuits 300 and 400, the scanning data circuit 600, display data holding circuit 700, and timing controller 500 are the same as that of the embodiment of FIG. 1. A multi-power source 250 provides, for example, bias voltage $V_7$. Switching circuits 350 and 450 respectively include a plurality of switches 352 and 452. In the embodiment shown in FIG. 8, the switching circuit 350 is connected between the X-bias selection circuit 300 and X electrodes of the LCD panel 100, which selects an output signal from the X-bias selection circuit 300 and fixed bias voltages $V_7$ in accordance with the control signal B.

In addition, the switching circuit 450 is connected between the Y-bias selection circuit 400 and Y electrodes of the LCD panel 100 and the fixed bias voltage $V_7$ and the output signal from the selection circuit 400 are switched by the control signal B.

In the display mode, if the control signal B at an "L" level, the switching circuit 350 transmits the output signal from the X-bias selection circuit 300 to the X electrodes of the LCD 100, and the switching circuit 450 transmits the output signal from the Y-bias selection circuit 400 to the Y electrode of the LCD panel 100.

The display cell of the LCD panel 100 is placed in an active state in conformity with display data.

Then, in the non-display mode, with the control signal B changed to an "H" level, switches 352 and 452 of the switching circuits 350 and 450 are all switched to the side of the bias potential $V_7$.

Accordingly, irrespective of the output states of the selection circuits 300 and 400, the potential $V_7$ is supplied to all of the X electrodes and Y electrodes of the LCD panel.

As a result, a potential difference between the X and Y electrodes of the LCD panel 100 becomes equal to zero during the non-display mode, and causes all of the display cell to be in an inactive state.

Figure 9:
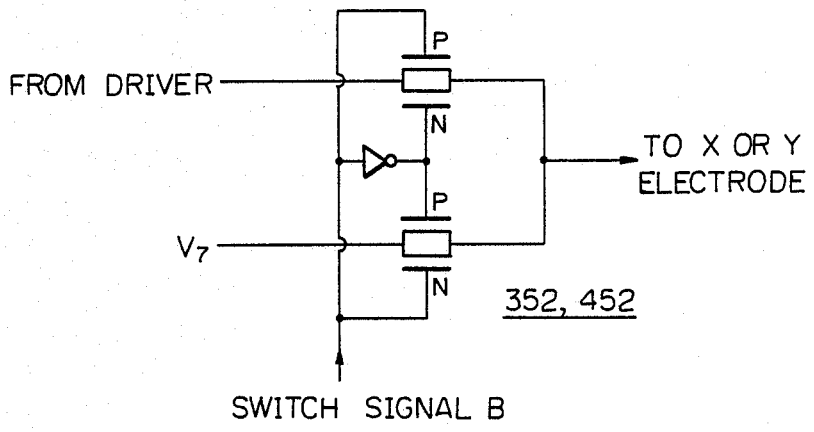
FIG. 9 is a circuit diagram of a switching circuit of FIG. 8 embodied by MOS transistors.
Figure 10:
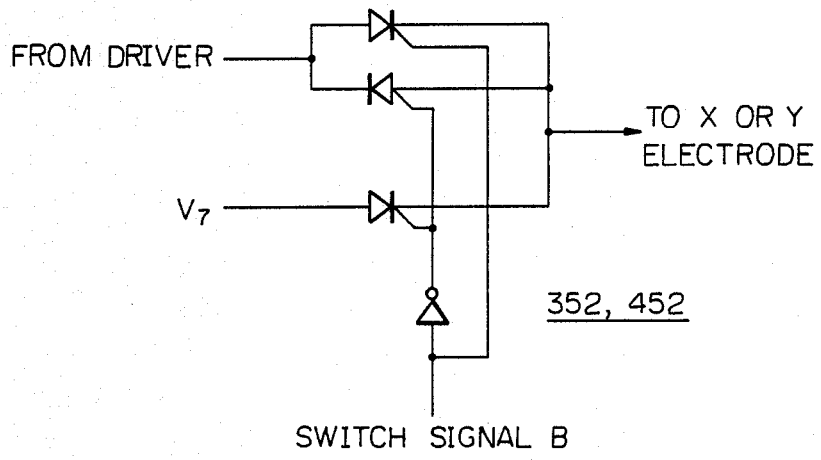
FIG. 10 is a circuit diagram of a switching means of FIG. 8 embodied by thyristors.

The switches 352 and 452 of the switching circuits 350 and 450 shown in FIG. 8 can be realized by P and N MOS transistors forming a CMOS switch, for example, as shown in FIG. 9.

According to the present invention, the potential difference between the X and Y electrodes of all of the display cells of the LCD display circuit in the non-display mode is made equal to zero. Accordingly, power consumption due to any charging or discharging current in the non-display mode can be reduced.

For example, in an operating an LCD panel having 640×200 display dots with a conventional display circuit, about 20 mw of power is consumed in the non-display mode, while in the present invention it can be sharply reduced to several microwatts.

Thus, the display circuit according to the present invention can operate for a long period of time only with a battery.

Although certain preferred embodiments have been shown and described, it should be understood that many changes and modifications may be made therein without departing from the scope of the appended claims.

What is claimed is:

1. An LCD panel CMOS display circuit for line-scanning and controlling an LCD panel having a plurality of X and Y electrodes arranged in a matrix form and having a plurality of liquid crystal display cells between said X and Y electrodes, comprising:

(a) a timing control circuit for generating a serial scanning data signal, a serial display data signal, a first shift clock signal, a second shift clock signal, a first control signal, and a second control signal;

(b) a multi-power source for producing a first group of bias voltages and a second group of bias voltages;

(c) a scanning data converter coupled to said timing control circuit for sequentially converting said scanning data from said timing control circuit in response to said first shift clock signal so as to convert said scanning data into scanning data in a parallel form which are output on a plurality of output lines;

(d) a first gate having a plurality of output lines and coupled to said output lines of said scanning data converter for selectively transmitting said scanning data from said converter in response to said first control signal;

(e) an X-bias selection circuit coupled to said first gate and including a plurality of first decoders and a plurality of drivers, each of said plurality of decoders coupled to one of said output lines of said first gate for converting a signal supplied thereto into a specific coded signal in response to a third control signal, each of said plurality of drivers coupled to a different one of said plurality of decoders for delivering a specific one of said first group of bias voltages to one of said X electrodes of said LCD matrix panel in response to its specific coded signal;

(f) a display data holding circuit for converting said serial display data signal into parallel data in response to said second shift clock signal and for selectively outputting said parallel data on a plurality of output lines in response to said first shift clock signal;

(g) a second gate having a plurality of output lines and coupled to said output lines of said display data holding circuit for selectively transmitting said parallel data in response to said first control signal;

(h) a Y-bias selection circuit coupled to said second gate including a plurality of second decoders and a plurality of drivers, each of said plurality of decoders coupled to one of said output lines of said second gate for converting a signal supplied thereto into a specific coded signal in response to a fourth control signal, each of said plurality of drivers coupled to different one of said plurality of decoders for delivering a specific one of said second group of bias voltages to one of said Y electrodes of said LCD matrix panel in response to its specific coded signal; and (i) a mode switching circuit coupled to said first and second pluralities of decoders for transmitting said second control signal to said first and second pluralities of decoders when said first control signal is in a first logic level, whereby said LCD panel is placed in a display mode, and for ceasing the transmission of said second control signal when said first control signal is in a second logic level, whereby the same bias voltage is provided to said X and Y electrodes of said LCD panel so as to place said LCD panel in a non-display mode.

2. An LCD panel CMOS display circuit according to claim 1, wherein said mode switching circuit comprises an OR gate circuit having an output coupled to said first plurality of decoders of said X-bias selection circuit, a first input for receiving said first control signal, and a second input for receiving said second control signal, and further comprises an AND gate circuit having an output coupled to said second plurality of decoders of said Y-bias selection circuit, a first input for receiving said first control signal, and a second input for receiving said second control signal; and first gate comprises a plurality of OR gate circuits; and said second gate comprises a plurality of OR gate circuits.

3. An LCD panel CMOS display circuit for line-scanning and controlling an LCD panel having a plurality of X and Y electrodes arranged in a matrix form and having a plurality of liquid crystal display cells between said X and Y electrodes, comprising:

(a) a timing control circuit for generating a serial scanning data signal, a serial display data signal, a first shift clock signal, a second shift clock signal, a first control signal, and a second control signal;

(b) a multi-power source for producing a first group of bias voltages and a second group of bias voltages;

(c) a scanning data converter coupled to said timing control circuit for sequentially converting said scanning data from said timing control circuit in response to said first shift clock signal so as to convert said scanning data into scanning data in a parallel form which are output on a plurality of output lines;

(d) an X-bias selection circuit coupled to said scanning converter and including a first plurality of decoders and a plurality of drivers, each of said plurality of decoders coupled to one of said output lines of said scanning data converter for converting a signal supplied thereto into a specific coded signal in response to said first control signal, each of said plurality of drivers coupled to a different one of said plurality of decoders for delivering a specific one of said first group of bias voltage in response to said specific coded signal;

(e) a first gate coupled to said X-bias selection circuit for selectively transmitting either specific bias voltages from said plurality of decoders or a different bias voltage to said X electrodes of said LCD panel in response to said second control signal;

(f) a display data holding circuit for converting said serial display data signal into a parallel display data in response to said second shift clock signal and for selectively outputting said parallel data or a plurality of output lines in response to said first shift clock signal;

(g) a Y-bias selection circuit coupled to said display data holding circuit and including a second plurality of decoders and a plurality of drivers, each of said plurality of decoders coupled to one of said output lines of said display data holding circuit for converting a signal supplied thereto into a specific coded signal in response to said first control signal, each of said plurality of drivers coupled to a different one of said plurality of decoders for delivering a specific one of said second group of bias voltages in response to its specific coded signal; and (h) a second gate coupled to said Y-bias selection circuit for selectively transmitting either specific bias voltages from said plurality of decoders or said different bias voltage to said Y electrodes of said LCD panel in response to said second control signal, whereby said different bias voltage is supplied to said X and Y electrodes in a non-display mode of said LCD panel.

4. An LCD panel CMOS display circuit according to claim 3, wherein said first and second gates each comprise CMOS switches including P and N MOS transistors.

* * * * *